US010006641B2

(12) United States Patent
Bruckbauer

(10) Patent No.: US 10,006,641 B2
(45) Date of Patent: Jun. 26, 2018

(54) HOB WITH CENTRAL REMOVAL OF COOKING VAPOURS BY SUCTION-EXTRACTION IN THE DOWNWARD DIRECTION

(76) Inventor: Wilhelm Bruckbauer, Neubeuern (DE)

( * ) Notice: Subject to any disclaimer, the term of this patent is extended or adjusted under 35 U.S.C. 154(b) by 659 days.

(21) Appl. No.: 14/114,351

(22) PCT Filed: Apr. 28, 2012

(86) PCT No.: PCT/DE2012/000458

§ 371 (c)(1),
(2), (4) Date: Oct. 28, 2013

(87) PCT Pub. No.: WO2012/146237

PCT Pub. Date: Nov. 1, 2012

(65) Prior Publication Data

US 2014/0048057 A1 Feb. 20, 2014

(30) Foreign Application Priority Data

Apr. 28, 2011 (DE) ..... 20 2011 005 698 U

(51) Int. Cl.
*F24C 15/00* (2006.01)
*F24C 15/20* (2006.01)

(52) U.S. Cl.
CPC ..... *F24C 15/2042* (2013.01); *F24C 15/2035* (2013.01)

(58) Field of Classification Search
CPC .. F24C 15/20; F24C 15/2042; F24C 15/2035; F24C 15/32; F24C 15/322
USPC ..... 126/299 D, 299 R, 21 R, 300
See application file for complete search history.

(56) References Cited

U.S. PATENT DOCUMENTS 2,674,991 A 4/1954 Schaefer
3,409,005 A * 11/1968 Field ..... F24C 15/2042 126/299 R
3,587,555 A 6/1971 Cerola
4,501,260 A * 2/1985 Grace ..... F24C 15/2092 126/21 R (Continued)

FOREIGN PATENT DOCUMENTS

DE 10 2007 002 241 7/2008
DE 20 2009 008 286 10/2009

(Continued)

OTHER PUBLICATIONS

International Preliminary Report on Patentability for PCT/DE2012/000458 dated Nov. 21, 2013.

(Continued)

*Primary Examiner* — Nathaniel Herzfeld
(74) *Attorney, Agent, or Firm* — McGlew and Tuttle, P.C.

(57) ABSTRACT

A hob (1) with one or more cooking locations (2), which, as viewed from above, exhibits one or more recesses (4) only in the area (25) around its geometric center (3), which are respectively connected with one or more devices (5) for removing cooking vapors through suction, wherein these devices (5) for removing cooking vapors through suction downwardly remove the cooking vapors that arise above the cooking locations (2) by suction in a direction pointing vertically below the hob (1), and such a hob (1), which in the assembly unit is designed with a device (36) for operating the hob (2) and downwardly removing cooking vapors by suction.

21 Claims, 17 Drawing Sheets

(56) References Cited

U.S. PATENT DOCUMENTS

| | | | | |
|---|---|---|---|---|
| 4,750,470 | A * | 6/1988 | Beach | F24C 15/2042 126/299 D |
| 4,846,146 | A * | 7/1989 | Tucker | F24C 15/2042 126/299 D |
| 4,899,028 | A * | 2/1990 | Arai | F24C 15/101 126/21 A |
| 5,279,279 | A * | 1/1994 | White | F24C 15/2042 126/214 D |
| 5,325,842 | A * | 7/1994 | Beach | F24C 15/2042 126/21 R |
| 5,619,982 | A * | 4/1997 | Kelly | F24C 15/2021 126/299 D |
| 5,884,619 | A * | 3/1999 | Terry | F24C 15/2042 126/299 D |
| 6,455,818 | B1 | 9/2002 | Arntz et al. | |
| 7,002,110 | B2 * | 2/2006 | Satou | F24C 15/2042 126/299 D |
| 7,069,923 | B2 * | 7/2006 | Seong | H05K 7/20209 126/300 |
| 2005/0088128 | A1 | 4/2005 | Seong | |
| 2007/0062513 | A1 * | 3/2007 | Gagas | F24C 15/2021 126/299 D |
| 2010/0116263 | A1 * | 5/2010 | Bruckbauer | F24C 15/2071 126/299 D |
| 2010/0163549 | A1 * | 7/2010 | Gagas | H05B 6/1209 219/622 |
| 2012/0204855 | A1 * | 8/2012 | Huber | F24C 15/2035 126/299 R |

FOREIGN PATENT DOCUMENTS

| | | |
|---|---|---|
| DE | 10 2009 025 038 | 12/2010 |
| WO | WO 2007/134500 | 11/2007 |

OTHER PUBLICATIONS

International Search Report for PCT/DE2012/000458 dated Aug. 5, 2012.

European Office Action, Patent Application No. 15 177 616.8, dated Aug. 1, 2016, 5 pages.

* cited by examiner

HOB WITH CENTRAL REMOVAL OF COOKING VAPOURS BY SUCTION-EXTRACTION IN THE DOWNWARD DIRECTION

The present invention relates to a hob with the features indicated in claim 1.

Known from prior art is a hob that exhibits oblong, rectangular slits on both sides and on the back, through which cooking vapours that arise in the hob area are downwardly removed through suction.

This hob known from prior art with suction slits provided on both sides and on the back is disadvantageous in particular because the countertop that carries the hob cannot be completely used for temporary storage or similar purposes, at least right to the side of the hob.

This hob encompassed by prior art with suction slits provided on both sides and on the back is also disadvantageous because the two lateral and rear suction flows cancel each other out completely or at least partially, above all in the especially important area in the centre of the hob, so that cooking vapours that arise there are not exposed to any effective suction flow, thus allowing them to expand and rise unimpeded.

Another disadvantage to this hob originating from prior art with suction slits provided on both sides and on the back is that it entails marked manufacturing and material costs, in particular due to the design of the three suction devices and the foul-air duct system connected with the latter.

The maintenance costs for this known hob are also especially high, in particular since it has three (!) grease filters that have to be maintained.

Since strong suction flows are released at the same time through all suction slits in this known hob with suction slits provided on both sides and on the back when the cooking vapour suction device is activated, the energy expenditure required for removing cooking vapours through suction is there especially high, giving this known hob a noticeably low efficiency.

In light of the three strong suction flows required there, the exposure to noise generated by the flows and fan motors of the suction system is also pronounced there.

Another important disadvantage to the known hob with cooking vapour suction slits provided on both sides and on the back is that it requires a material and time-intensive assembly of the hob on the countertop carrying the hob by means of a separate mounting frame, while bridging the cooking vapour suction slits on both sides and on the back.

Therefore, the object of the present invention is to provide a hob with a device for removing cooking vapours through suction in a direction lying vertically below the plane of the hob, which does not use the surfaces on the countertop carrying the hob that are located on both sides and on the back of the hob, but rather allows them to be used for temporary storage or similar purposes, which reliably prevents cooking vapours from rising and expanding both in the central area of the hob and in its edge areas, which entails especially low manufacturing, assembly, maintenance and operating costs, which requires no separate mounting frame for securing the enveloping countertop, which is especially efficient in terms of the energy used for suction purposes, and which generates very little noise during its operation.

According to the invention, this object is achieved in a generic device by the features indicated in the characterizing clause of claim 1. Especially preferred embodiments are the subject of the subclaims. Exemplary embodiments are described in more detail based on the drawings. Shown on:

Figure 1:
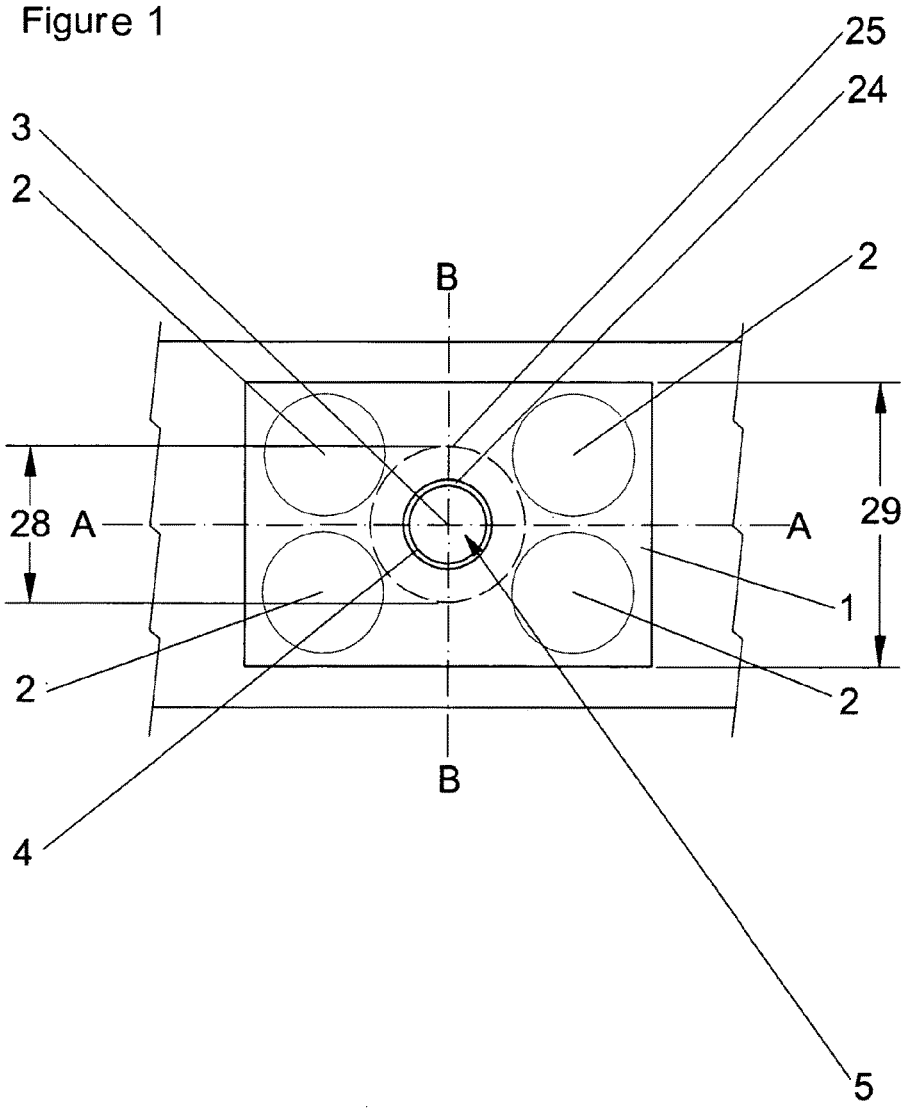
FIG. 1 is a top view of a hob (1) according to the invention with a central recess (4) for a device (5) for downwardly removing cooking vapours through suction.
Figure 3:
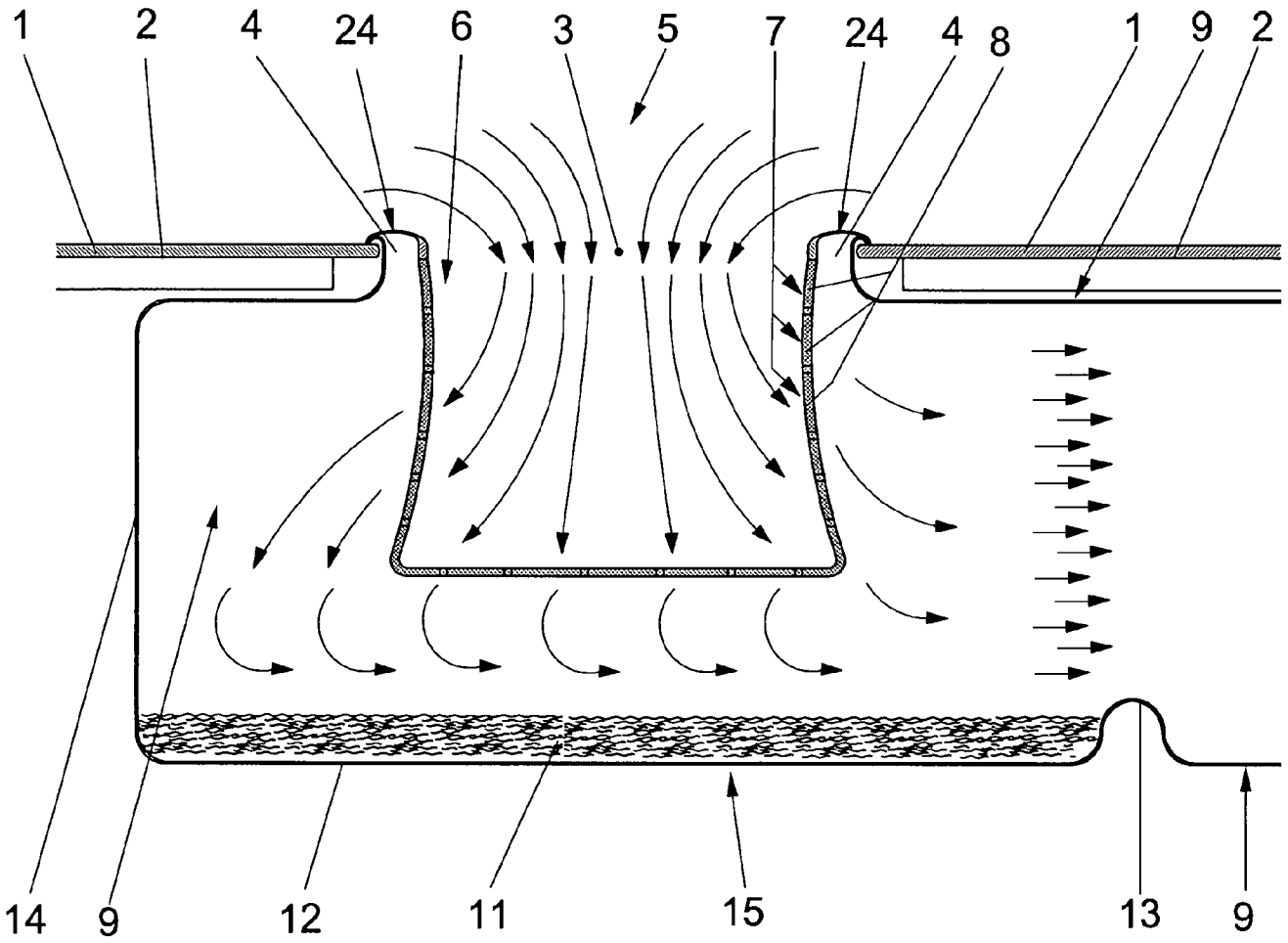
Figure 4:
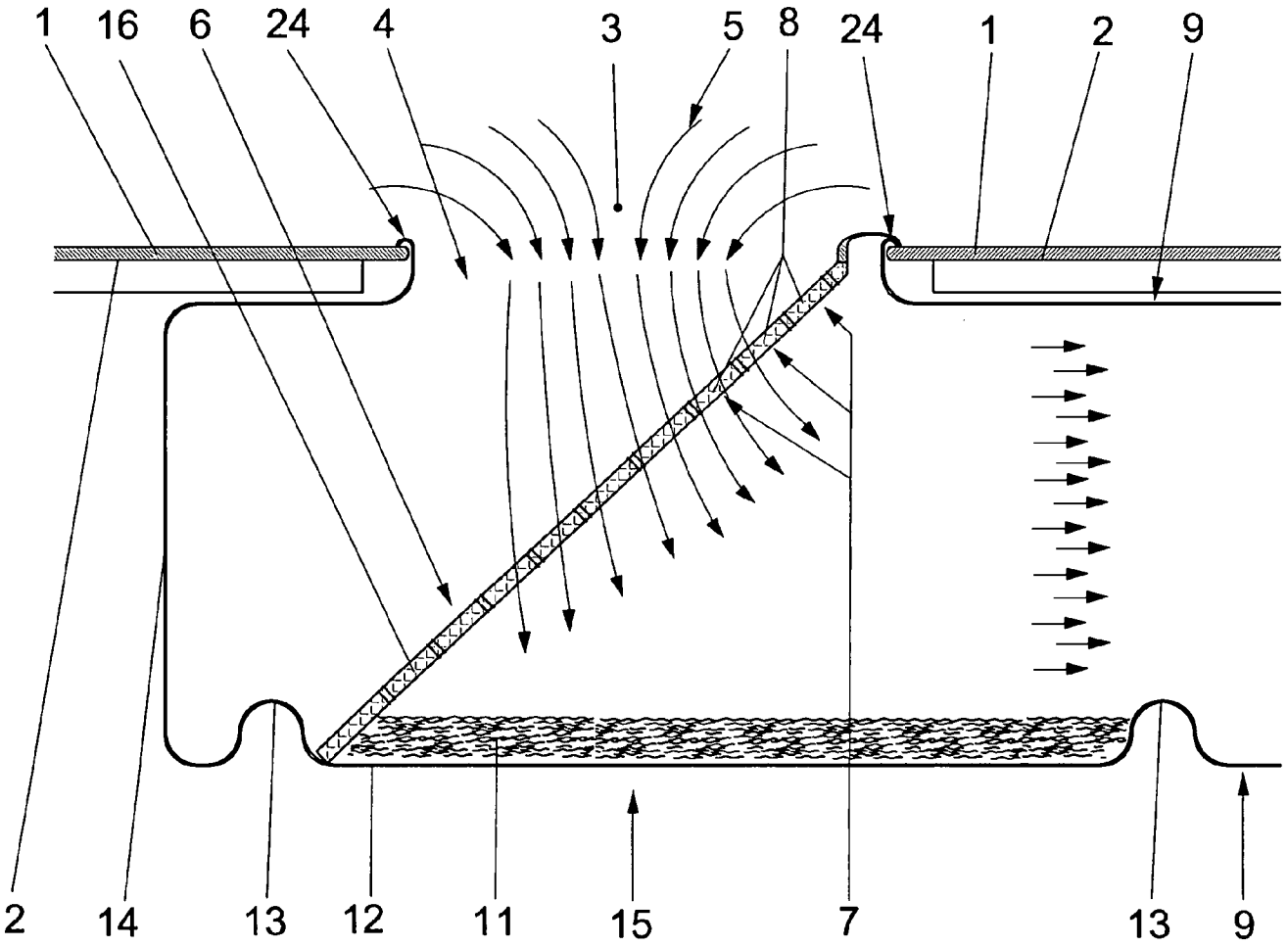
Figure 5:
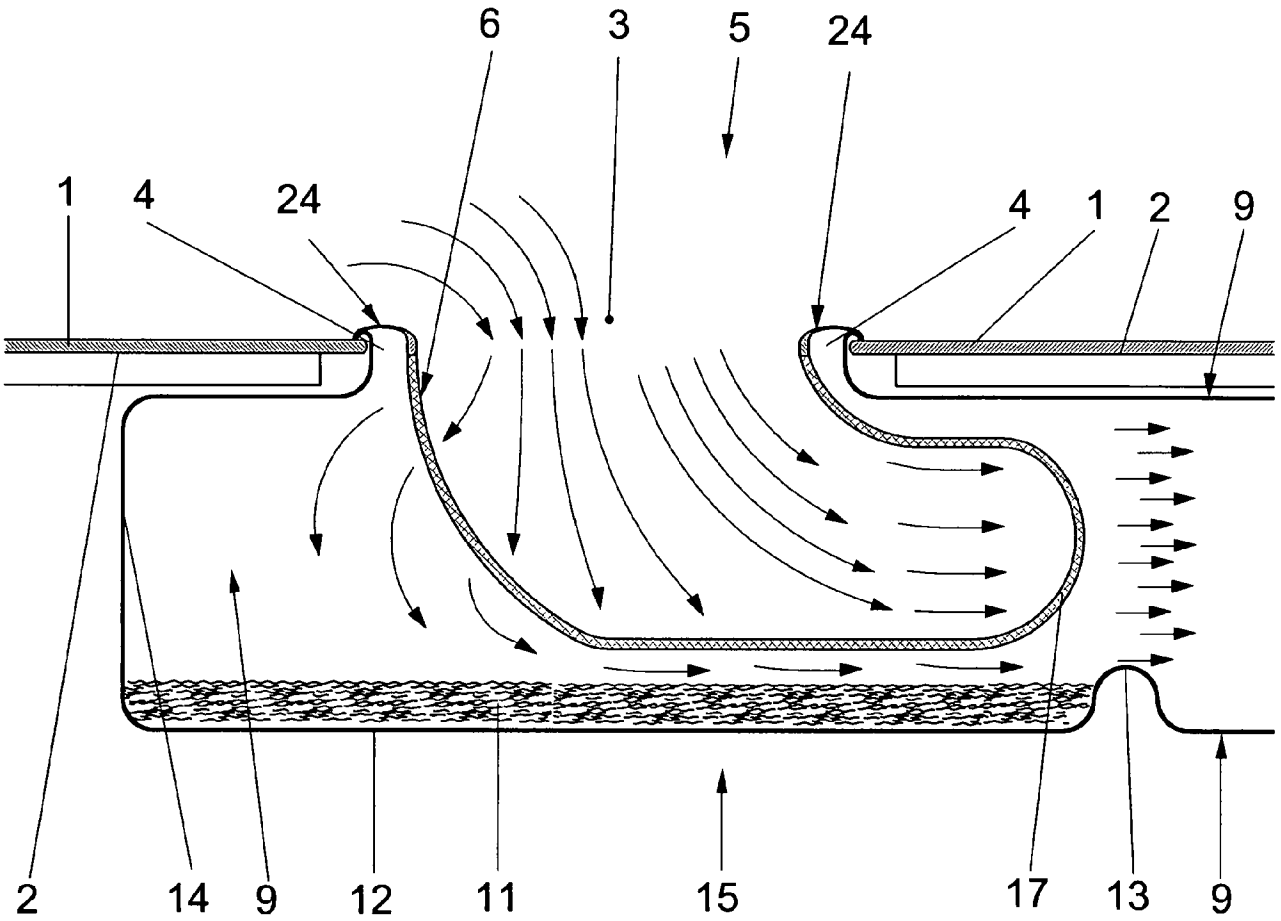
Figure 6:
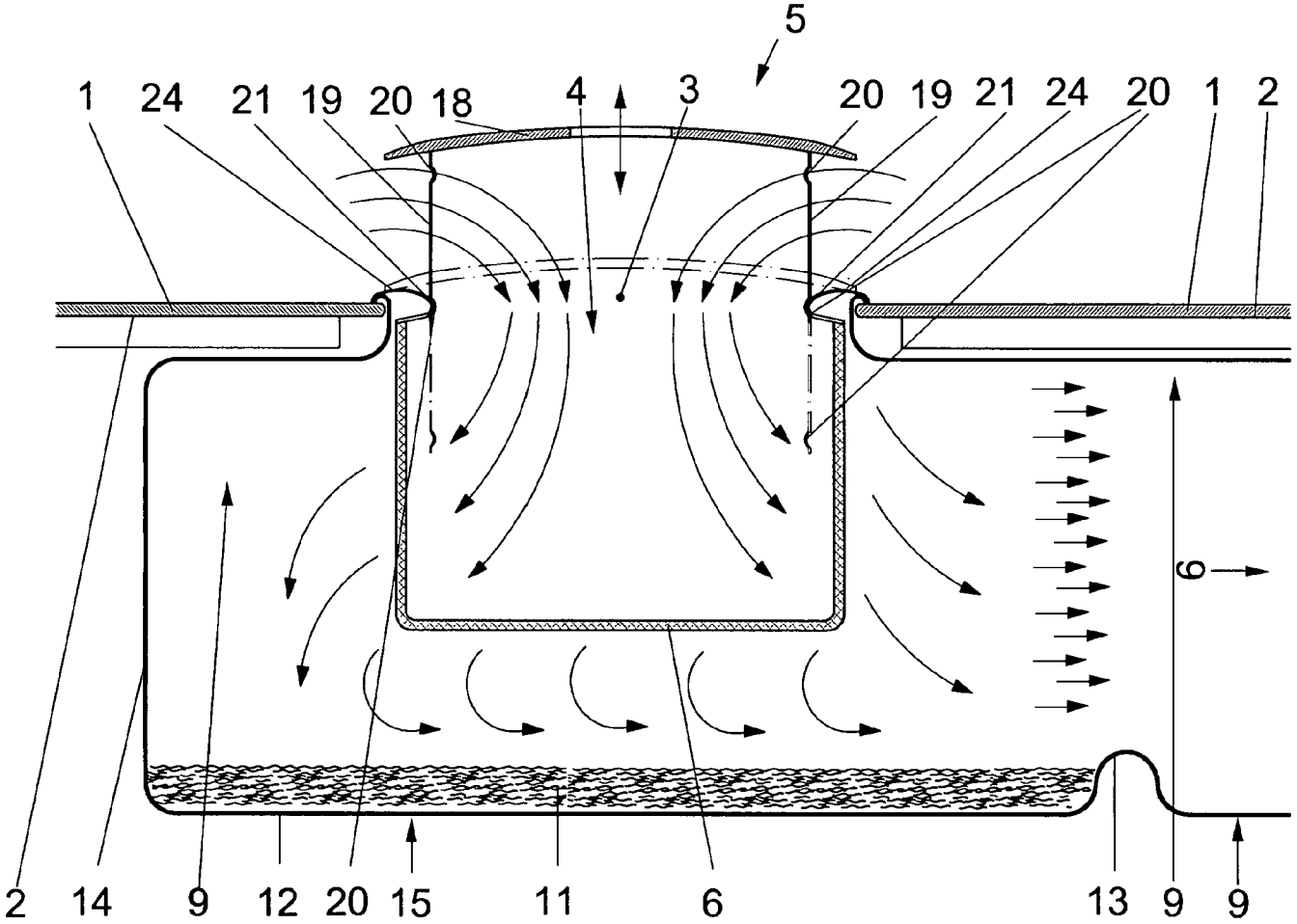
Figure 7:
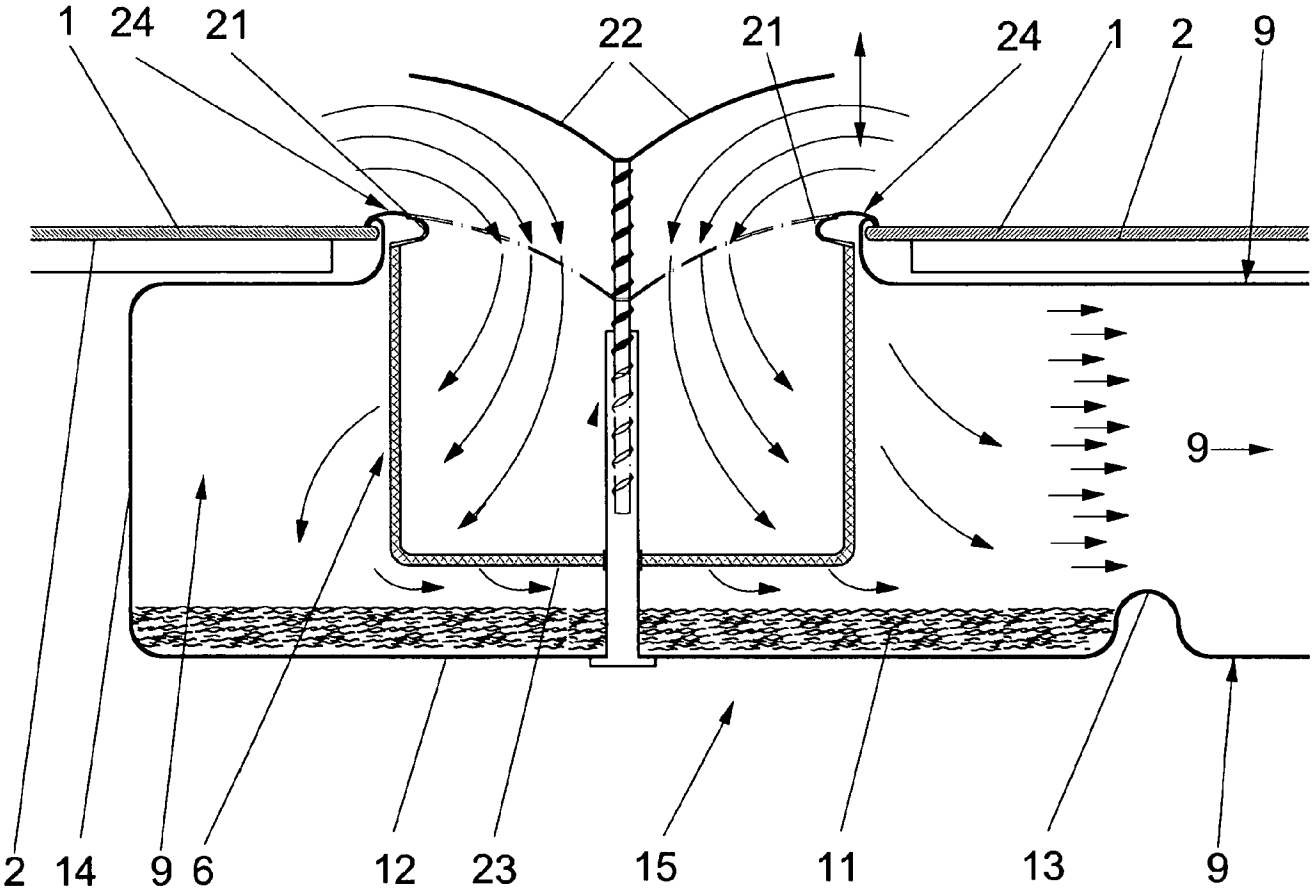
Figure 8:
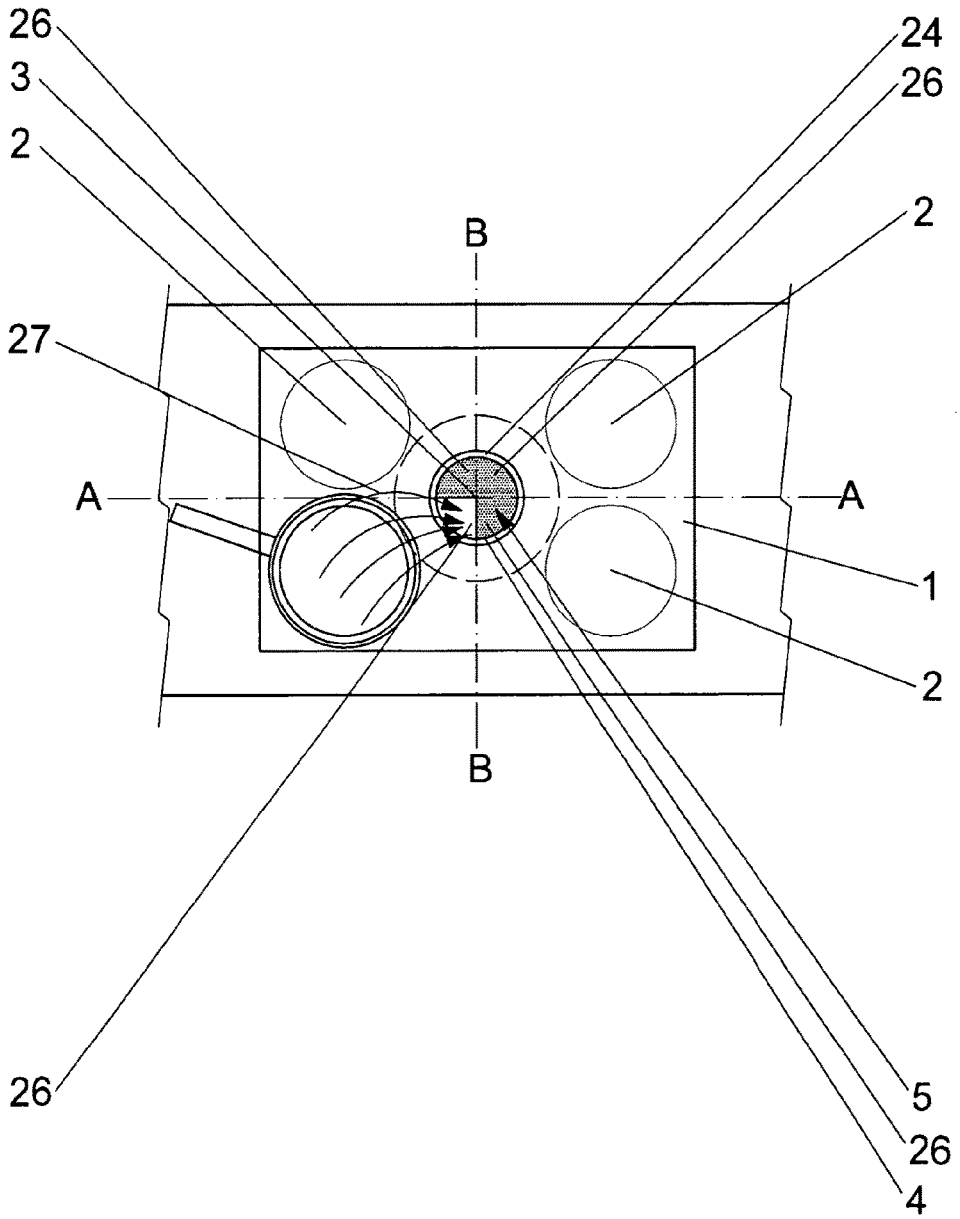
Figure 9:
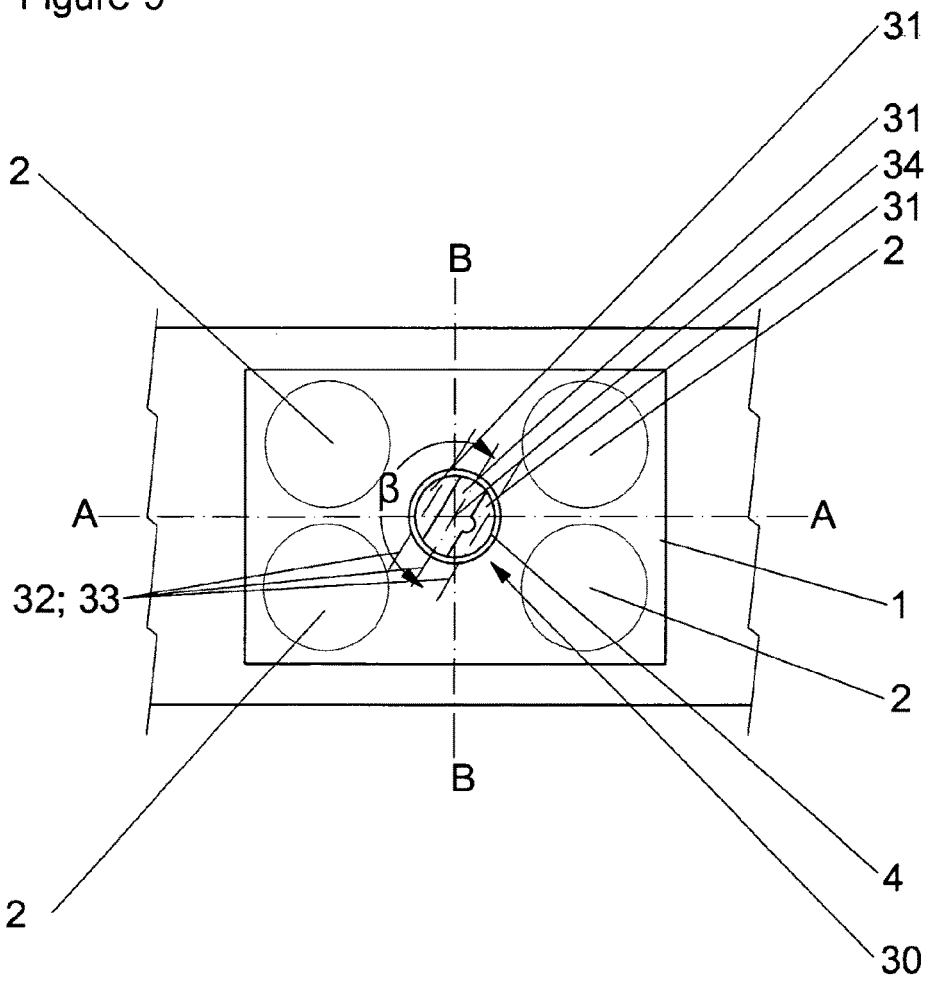
Figure 10:
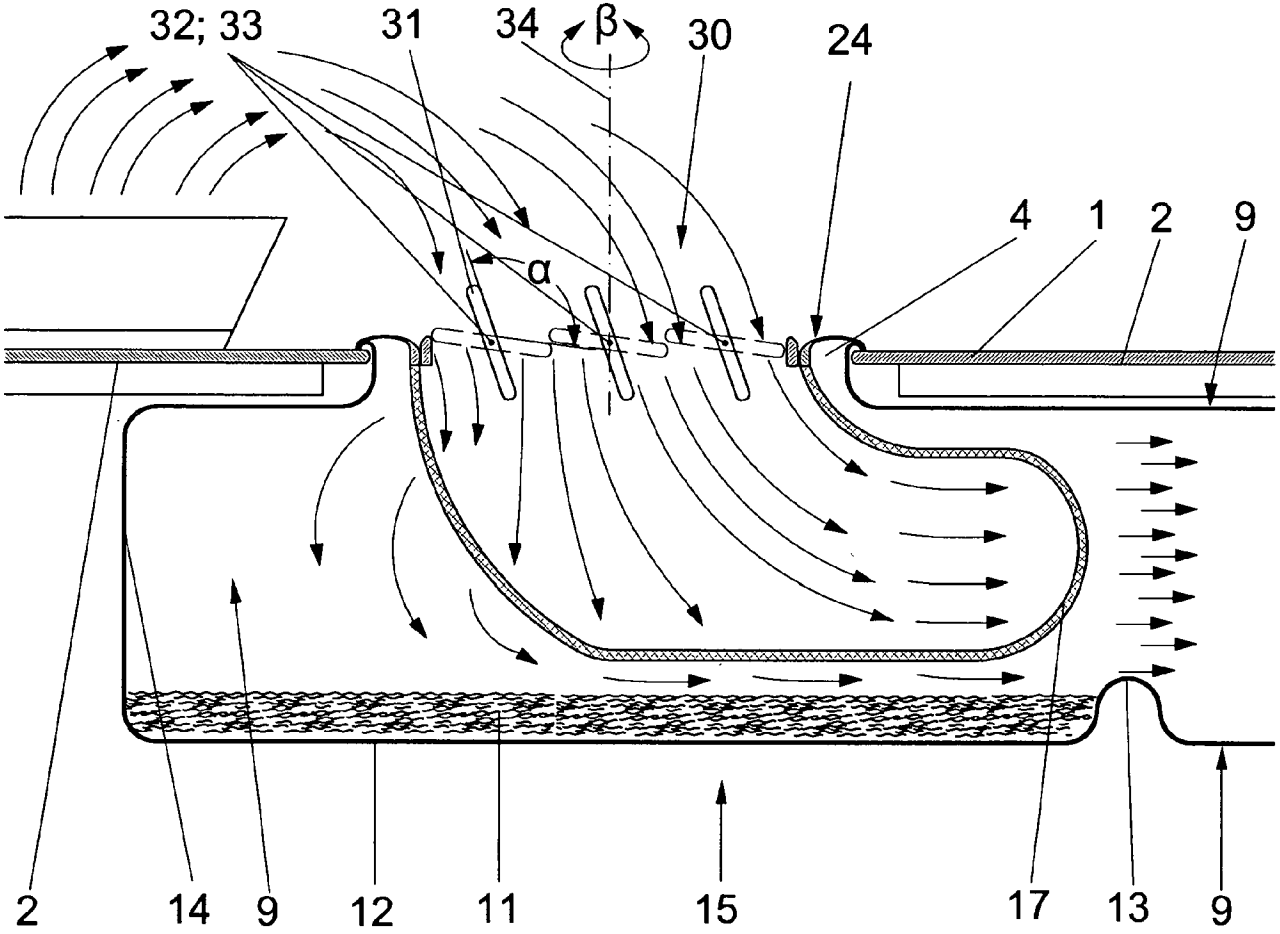
Figure 11:
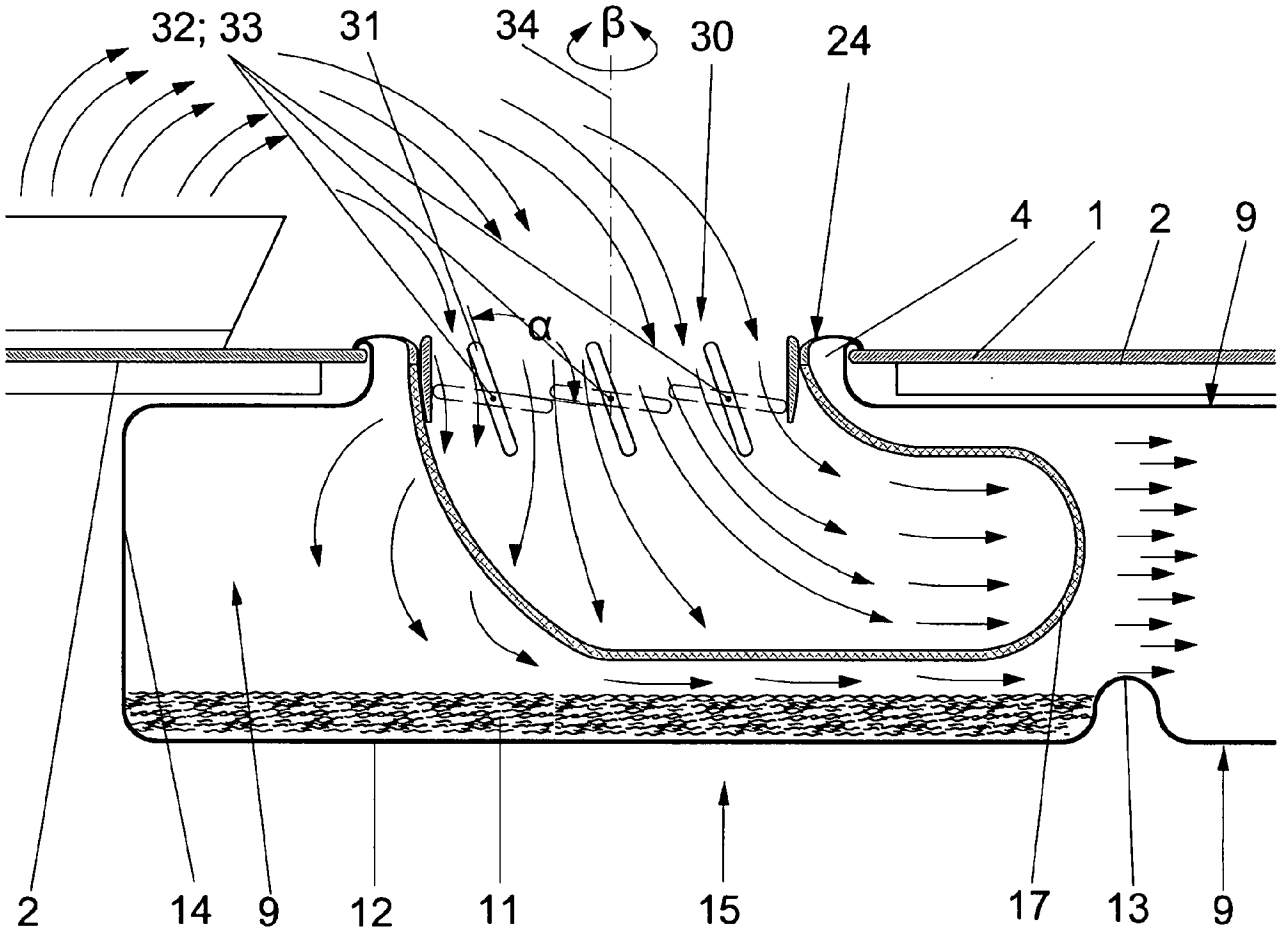
Figure 12:
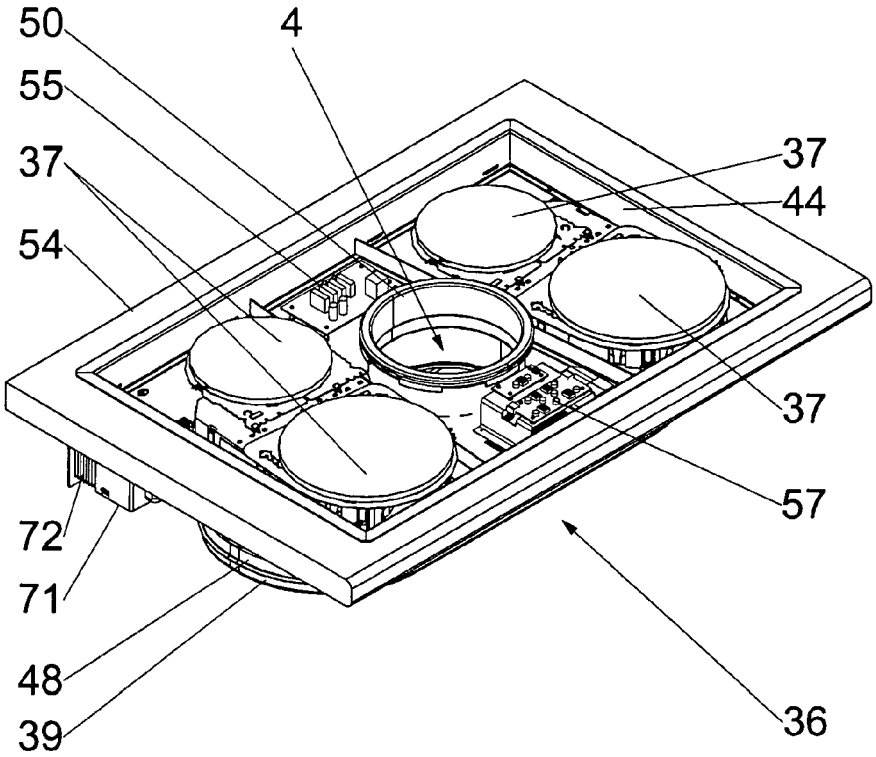
Figure 13:
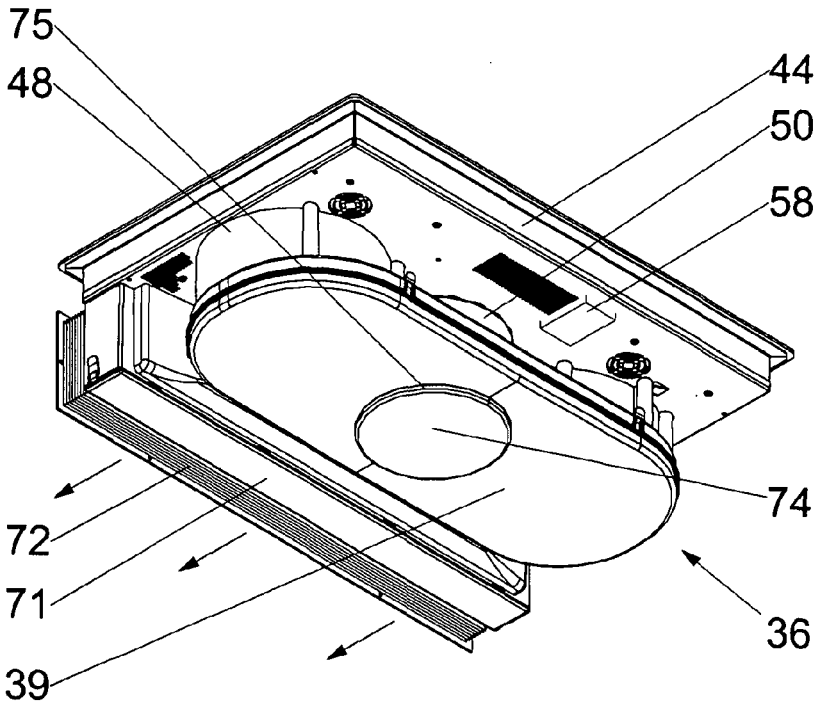
Figure 14:
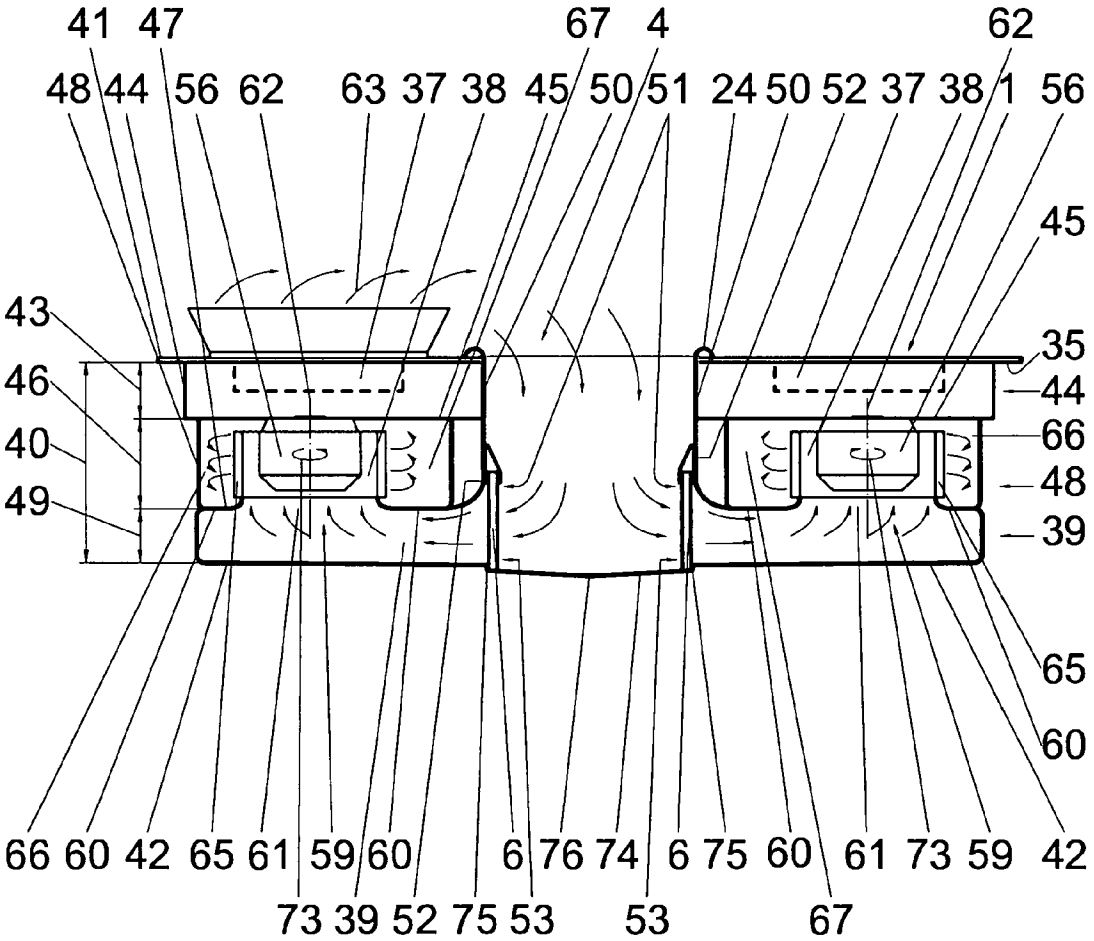
Figure 15:
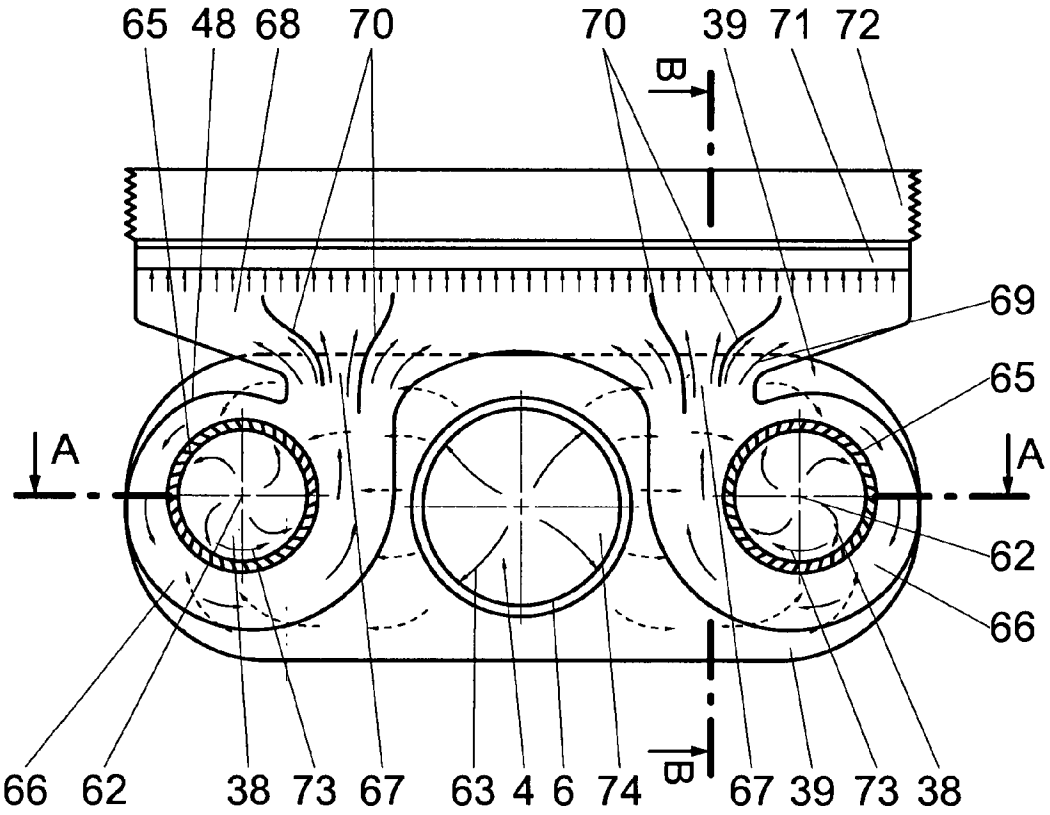
Figure 16:
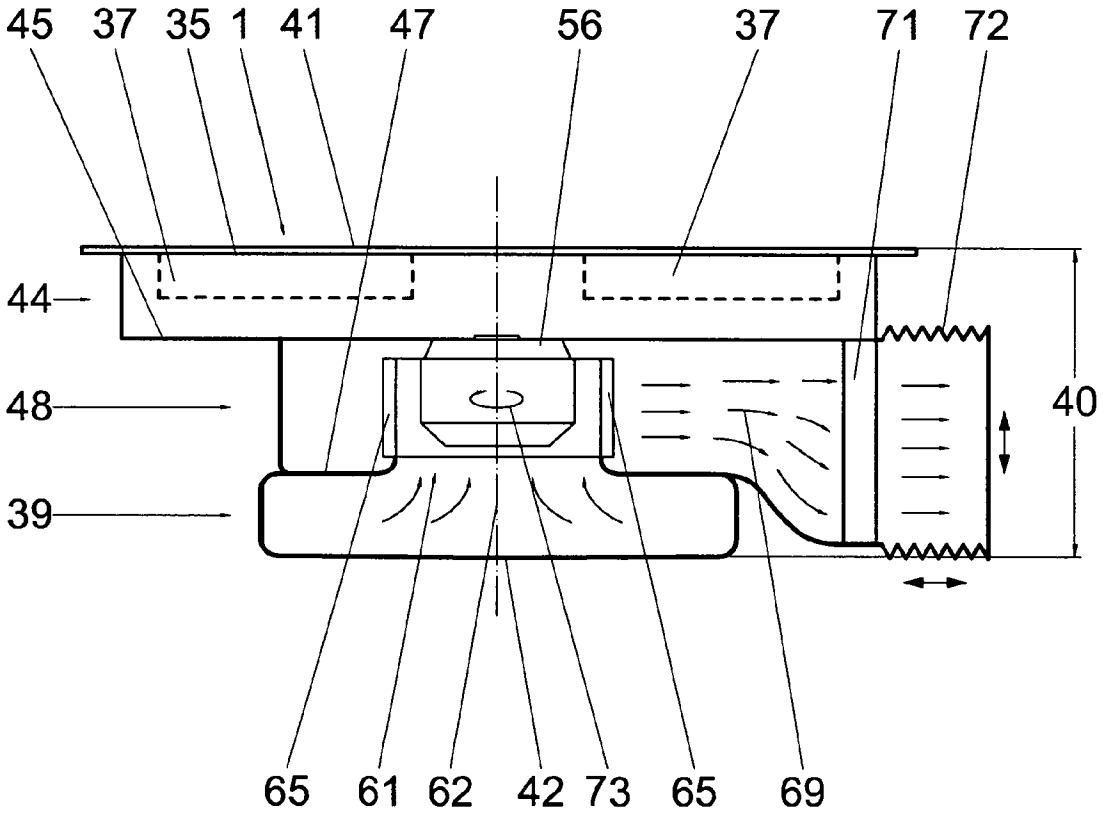
Figure 17:
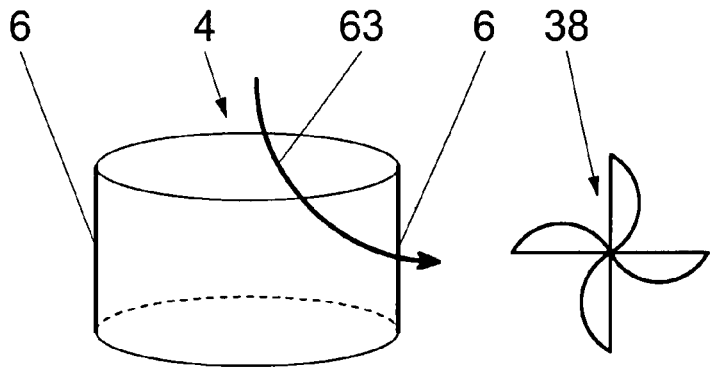
Figure 18:
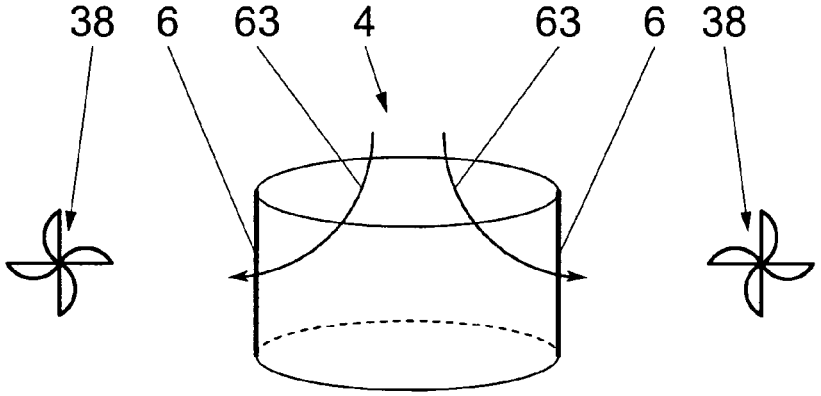

FIG. 3 is a schematic cross section of a hob (1) according to the invention along the B-B line depicted on FIG. 1 with a grease filter insert (6), whose lateral walls and floor are permeable to the imbibed cooking vapours in the direction of the foul-air duct (9), wherein the bottom side (12) of the foul-air duct (9) below the area of the central recess (4) takes the form of a collecting basin (15) for liquids (11);

FIG. 4 is a schematic cross section of a hob (1) according to the invention along the B-B line depicted on FIG. 1 with an inclined, plate-type grease filter plate (16), which covers the cross section of the foul-air duct (9), and is provided below the central recess (4) of the hob (1);

FIG. 5 is a schematic cross section of a hob (1) according to the invention along the B-B line depicted on FIG. 1 with a grease filter insert (6), which is shaped like the letter U with a cap-like expansion (17) of the lower area hereof in a downstream direction and permeable to cooking vapour;

FIG. 6 is a schematic cross section of a hob (1) according to the invention along the B-B line depicted on FIG. 1, wherein the central recess (4) of the hob (1) can be opened and closed by means of a cover-type closure element (18) that can be reversibly displaced in a vertical direction, wherein two flexible fork legs (19) with locking grooves (20) for locking in projections (21) of the grease filter insert (6) are provided on the lower side of the closure element;

FIG. 7 is a schematic cross section of a hob (1) according to the invention along the B-B line depicted on FIG. 1, wherein the central recess (4) of the hob (1) can be opened and closed by means of a Y-shaped closure element (18) that can be reversibly displaced in a vertical direction, wherein the lower side of this Y-shaped closure element (22) acts as a flow optimizing and guiding surface for the imbibed cooking vapours, and the Y-shaped closure element (22) can be vertically displaced by means of a thread (23);

FIG. 8 is a schematic top view of a hob (1) according to the invention, which in the area (25) of the geometric centre (3) of the hob (1) exhibits a recess (4) in the hob (1), which encompasses one or more sector-type closure elements (26) that can be reversibly closed and opened so as to control the direction (27) of cooking vapour removal by suction as a function of the direction of the respective cooking location (2) that is generating cooking vapour, as well as to economize the fan energy to be expended on the device (5) for removing cooking vapours by suction;

FIG. 9 is a schematic top view of a hob (1) according to the invention, whose central recess (4) carries a bladed shutter (30);

FIG. 10 is a schematic cross section of a hob (1) along the B-B line depicted on FIG. 9, wherein the central recess (4) of the hob (1) can be reversibly closed by means of a bladed shutter (30) with swivelling blades (31) provided just above the plane of the hob (1);

FIG. 11 is a schematic cross section of a hob (1) along the B-B line depicted on FIG. 9, wherein the central recess (4) of the hob (1) can be reversibly closed by means of a bladed shutter (30) with swivelling blades (31) provided just below the plane of the hob (1);

FIG. 12 is a schematic, perspective top inclined view of a hob (1) according to the invention with a central recess (4) of the hob (1), wherein the hob (1) takes the form of an assembly unit with a device (36) provided on the lower side (35) of the hob (1) for operating the hob (1) and downwardly removing cooking vapours by suction;

FIG. 13 is a schematic, perspective inclined view of a hob (1) according to the invention shown on FIG. 12 with a central recess (4) of the hob (1), wherein the hob (1) takes the form of an assembly unit with a device (36) provided on the lower side (35) of the hob (1) for operating the hob (1) and downwardly removing cooking vapours by suction;

FIG. 14 is a schematic, longitudinal section along the A-A line of the assembly unit depicted on FIG. 15 comprised of a hob (1) and a device (36) for operating the hob (1) and downwardly removing cooking vapours by suction;

FIG. 15 is a schematic top view of an assembly unit according to the invention comprised of a hob (1) and a device (36) for operating the hob (1) and downwardly removing cooking vapours by suction, wherein the hob (1) has been removed to improve the clarity of the image;

FIG. 16 is a schematic, longitudinal section along the B-B line of the assembly unit depicted on FIG. 15 comprised of a hob (1) and a device (36) for operating the hob (1) and downwardly removing cooking vapours by suction;

FIG. 17 is a schematic view of a hollow cylindrical grease filter (6), which is connected only with a single foul-air vent (38);

FIG. 18 is a schematic view of a hollow cylindrical grease filter (6), which is connected with two opposing foul-air vents (38).

As a consequence, the present invention relates to a hob (1) with one or more cooking locations (2), which as viewed from above exhibits one or more recesses (4) only in the area (25) around its geometric centre (3), but not in its edge areas.

As a rule, these recesses (4) are connected with one or more devices (5) for removing cooking vapours through suction, wherein these devices (5) for removing cooking vapours through suction downwardly remove the cooking vapours that arose or arise above the cooking location(s) (2) by suction in a direction pointing vertically below the hob (1).

In general, the diameter (28) of the area (25) for the one or several recesses (4) around the geometric area centre (3) of the hob (1) can measure between 10% and 90% of the overall width (29) of the hob (1), preferably between 15% and 85%, in particular between 20% and 80% of the overall width (29) of the hob (1). The shape of the one or more recesses (4) as viewed from above can preferably be round or oval or square or rectangular or polygonal or radial. For example, the surface of the recess (4) of the hob (5) can measure between 50 $cm^2$ and 500 $cm^2$, preferably between 60 $cm^2$ and 400 $cm^2$, in particular between 70 $cm^2$ and 300 $cm^2$. Each recess (4) of the hob (1) can preferably be reversibly closed and opened manually and/or by means of an electric or pneumatic drive, whether over the entire surface or by sectors.

According to FIGS. 3, 5, 6 and 7, a one-part or multipart grease filter insert (6) can be inserted into each recess (4) of the hob (1). As a rule, this grease filter insert (6) is enveloped by a foul-air duct (9) from the sides and/or bottom. The grease filter insert (6) is preferably tightly connected with the edge area of the recess (4) of the hob (1).

For example, the grease filter insert (6) can exhibit a cross section shaped like the letter U (see FIGS. 2, 3, 6 and 7). As an alternative to the above, the grease filter insert (6) can take the form of the letter U with a sack-shaped or cap-shaped expansion (17) (see FIG. 5) of its lower area toward the side and/or in the downstream direction, so as to enlarge the filter surface and reduce the flow rate, and hence to improve the effect of the grease filter insert (6). In general, the wall areas of the grease filter insert (6) can exhibit suction openings (7) with grease filters (8) integrated therein, or be designed at least regionally like a gas-permeable grease filter (6).

Figure 2:
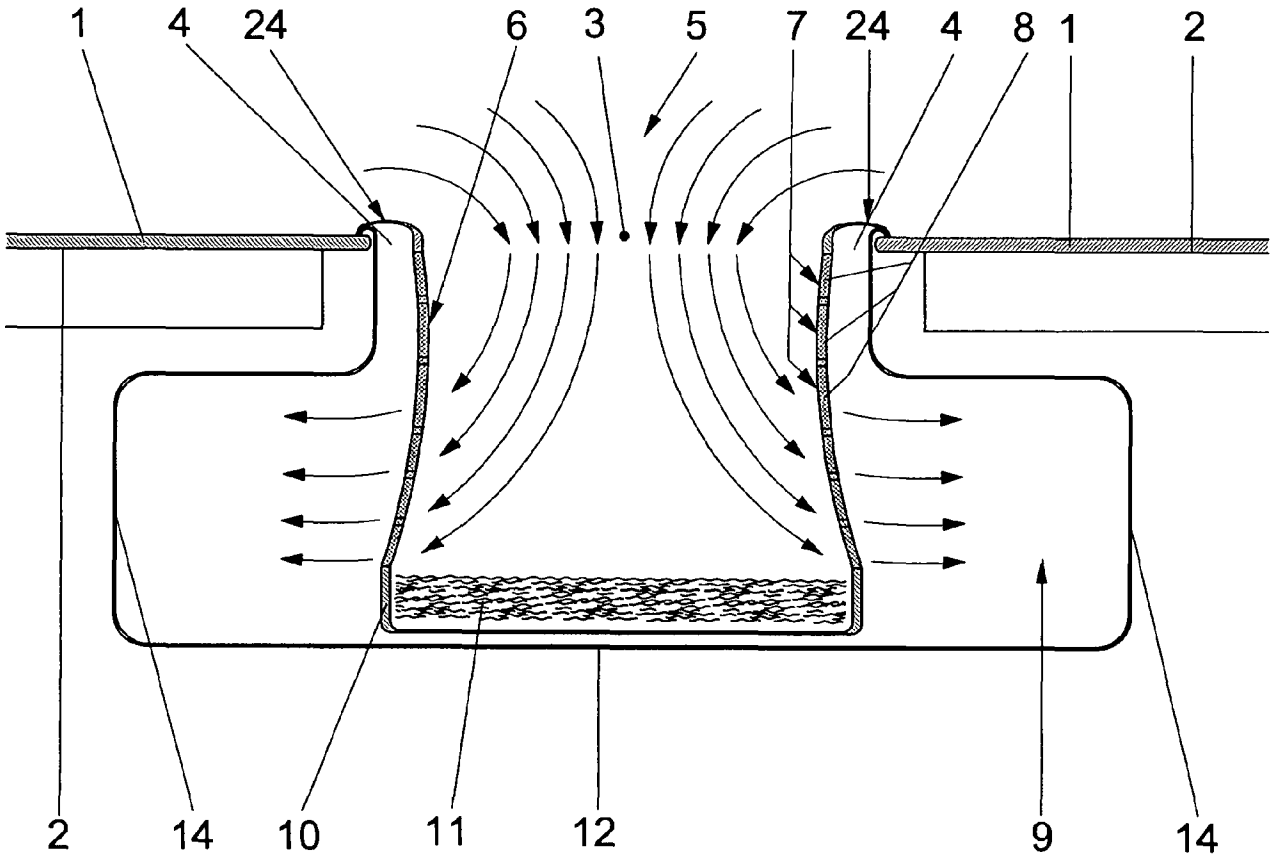
FIG. 2 is a schematic cross section of a hob (1) according to the invention along the A-A line depicted on FIG. 1 with a grease filter insert (6), whose floor area exhibits a collecting tray (10) for liquid that entered through the central recess (4), and whose lateral walls located above the latter are permeable to the imbibed cooking vapours in the direction of the foul-air duct (9)

As may be gleaned in particular from FIG. 2, the floor area of the grease filter insert (6) can be designed as a collecting tray (10) for collecting liquid (11) that entered into the recess (4) of the hob (1). As an alternative thereto, both the lateral walls of the grease filter insert (6) and its floor can be permeable to cooking vapours, as depicted on FIGS. 3, 4, 5, 6 and 7.

In order to prevent liquid (11) that penetrated through the central recess (4) of the hob (1) from further advancing into downstream sections of the foul-air duct (9), a liquid barrier (13) that is raised over the level of the bottom side (12) of the foul-air duct (9) can be provided on the bottom side (12) of the foul-air duct (9) immediately downstream behind the central recess (4).

One special advantage to the device according to the invention lies in the fact that the liquid collecting basin (15) provided below the central recess (4) of the hob (1) and bordered by the liquid barrier (13) downstream and otherwise by the walls (14) of the foul-air duct (9) can be manually drained and cleaned through the central recess (4) of the hob (1).

For example, according to FIG. 4, the grease filter insert (6) can be designed like a grease filter plate (16) that covers the cross section of the foul-air duct (9) and is inclined below the central recess (4) of the hob or just downstream from the latter.

For example, according to FIG. 6, the central recess (4) of the hob (1) can be closed over the entire surface by means of a cover-shaped closure element (18) that can be reversibly adjusted in a vertical direction for opening and closing purposes so as to seal out odours.

In this case, the bottom side of the closure element (18) can be provided with two or more flexible fork legs (19) with locking grooves (20) for locking in projections (21) of the grease filter insert (6), the foul-air duct (9) or the central recess (4).

As an alternative thereto, the bottom side of the closure element (18) can be provided with two or more rigid legs (19) with locking grooves (20) for locking in flexible projections (21) of the grease filter insert (6), the foul-air duct (9) or the central recess (4).

As shown on FIG. 7, the central recess (4) of the hob (1) can be closed by means of a closure element (22) with a Y- or V-shaped cross section that can be reversibly adjusted in a vertical direction for opening and closing purposes.

In this case, the bottom sides of this Y- or V-shaped closure element (22) can serve as flow optimizing and guiding surfaces for the cooking vapours to be removed by suction. The Y- or V-shaped closure element (22) can preferably be vertically and reversibly adjusted by means of an eccentric disk, a lever mechanism, or a thread (23).

As evident from FIG. 8, the recess (4) of the hob (1) located in the area (25) around the geometric centre (3) of the hob (1) can exhibit one or more sector-type closure elements (26) that can be reversibly closed and opened so as to control the direction (27) of cooking vapour removal by suction as a function of the direction of the respectively active cooking location (2) that is generating cooking vapour, as well as to economize the fan energy to be expended on the device (5) for removing cooking vapours by suction. For example, these closure elements (26) can be manually and/or electrically reversibly opened and closed.

As evident from FIGS. 1 to 8, the edge of the central recess (4) of the hob (1) can be provided with overflow protection by carrying a coupler (24) that projects above and envelops the plane of the hob (1), and is formed by the foul-air duct port and/or the grease filter insert suspension device.

FIGS. 9, 10 and 11 show that the one or several central recesses (4) of the hob (1) can each exhibit one or more bladed shutters (30) for flow optimization. This blade shutter (30) is advantageous in particular for a horizontal, and possibly also for a vertical, alignment of the cooking vapour suction flow (27) in the direction of the respectively active cooking location(s) (2).

As a rule, each bladed shutter (30) encompasses one or several blades (31), whose longitudinal axes (32) are preferably horizontally aligned.

In especially preferred embodiments of the hob (1) according to the invention, each blade (31) can be reversibly swivelled to and fro around a horizontal pivoting axis (33) at an angle $\alpha$, which can measure between 0° and 180°, preferably between 0° and 110°, in particular between 0° and 90°, especially so as to vertically align the cooking vapour suction flow (27), and hence to adjust to the vertical height of the used cookware.

For example, in particular to horizontally align the cooking vapour suction flow (27) in the direction of the respectively active cooking location(s) (2), the bladed shutter (30) can reversibly turn around its vertical axis (34) at an angle $\beta$. For example, this angle $\beta$ can measure between 0° and 360° without limitation. As may be gleaned in particular from FIG. 10, the plane of the bladed shutter (30) can lie just above the plane of the hob (1). As an alternative thereto, the plane of the bladed shutter (30) can lie roughly at the vertical height of the hob (1). However, according to FIG. 11, the plane of the bladed shutter (30) can also be provided below the hob (1). In especially preferred embodiments of the hob (1) according to the invention, the bladed shutter (30) can be removed from the central recess (4) of the hob (1) for cleaning purposes.

The present invention further relates to a hob (1) with a central recess (4), which takes the form of an assembly unit with a device (36) provided on its bottom side (35) for operating the hob (1) and downwardly removing cooking vapours by suction, and can be quickly and easily inserted into a recess of the kitchen countertop (54) whose dimensions correspond thereto.

As depicted in particular on FIGS. 12 to 16, the bottom side (35) of the hob (1) in the device (36) as viewed downwardly sequentially in a vertical direction can encompass a housing (44) for the heating or hob heating and control electronics, a fan housing (48) for two or more radial fans (38), and one or more cooking vapour aspiration chambers (39) for horizontally relaying the cooking vapours toward the outside, as well as for preparing the cooking vapour stream to be vertically aspirated toward the top by means of the radial fans (38) provided in the fan housing (48) situated vertically higher.

One special advantage to this hob (1) designed according to the invention is that the distance (40) between the bottom side (35) of the hob (1) on the one hand and the bottom side of the floor (42) of the cooking vapour aspiration chambers (39) on the other only measures between 110 mm and 260 mm, preferably between 140 mm and 230 mm, in particular between 150 mm and 200 mm.

As may be gleaned in particular from FIGS. 14, 15 and 16, for example, a tubular foul air line (50) directed vertically downward can be provided downstream from the central recess (4) of the hob (1) in this hob (1) designed as an assembly unit with a device (36).

As a rule, a hollow cylindrical filter (6) can be provided downstream after the foul air line (50), and can be reversibly removed toward the top through the central recess (4) of the hob (1) for cleaning purposes.

In general, the upper edge area (51) of the hollow cylindrical grease filter (6) can tightly abut against the inner wall of the lower section (52) of the tubular foul air line (50). The lower edge area (53) of the hollow cylindrical grease filter (6) can vertically project over the lower section (52) of the tubular foul air line (50) toward the bottom.

In preferred embodiments of the hob (1) according to the invention designed as an assembly unit with a device (36), two or more deep cooking vapour aspiration chambers (39) can be provided downstream from the hollow cylindrical grease filter (6) and laterally and horizontally outside of the latter for horizontally relaying the cooking vapours (63) that passed through the grease filter (6) toward the outside.

In particular FIGS. 14 and 16 show that two or more recesses (61) for guiding the cooking vapours (63) from the bottom up to the radial fans (38) provided downstream from the recesses (61) can be provided in the middle areas (59) of the covers (60) of the cooking vapour aspiration chambers (39) lying vertically at the top.

As may be gleaned in particular from FIGS. 14 and 16, the radial fan motors (56) can be centrally secured by way of their recesses (61) in the middle areas (59) of the covers (60) of the cooking vapour aspiration chambers (39) to the bottom side (45) of the housing (44) for the heating or hob heating and control electronics.

Among other things, for example, the housing (44) for the heating or hob heating and control electronics can incorporate the hob heating elements (37), the power electronics (55) for the fan motors (56) and touch-control operating components (57) (see FIG. 12). Among other things, for example, the bottom side of the housing (44) for the heating or hob heating and control electronics can be provided with a device power supply line (58) (see FIG. 13).

In particular FIGS. 14 and 16 show that the rotational axes (62) of the radial fan motors (56) can be vertically aligned, and that the cooking vapours (63) aspired vertically upward by the rotating fan wheel (65) can be transported in the fan housing (48) provided above the respective aspiration chamber (39).

As evident from FIG. 15, the fan housing (48) as viewed from above can exhibit a spiral structure with an upstream guiding chamber (66) followed downstream by a pressure chamber (67). According to FIG. 15, a space (68) adjoining all pressure chambers (67) of the radial fans (38) can be provided downstream from the pressure chambers (67) for dividing and aligning the cooking vapour exhaust flows (69). For example, this space (68) can exhibit two or more air guiding surfaces (70). These air guiding surfaces (70) can preferably be arranged and shaped in such a way as to uniformly blow the cooking vapour exhaust flows (69) against the odour filter (71) provided downstream from the dividing space (68) in relation to its overall surface.

As may be gleaned from FIG. 15, a bellows (72) flexible in the horizontal and/or vertical direction can be provided downstream from the odour filter (71) for establishing a flexible, vibration and noise-decoupled connection to a following downstream foul-air duct or kitchen structure.

In especially preferred embodiments of the hob (1) according to the invention designed as an assembly unit with a device (36), the cooking vapour (63) can flow through the hollow cylindrical grease filter insert (6) at a speed measuring between 1.0 m/sec and 4.5 m/sec, preferably between 1.15 m/sec and 4.25 m/sec, in particular between 1.75 m/sec and 4.0 m/sec. In preferred embodiments of the hob (1) according to the invention designed as an assembly unit with a device (36), the cooking vapour (63) can flow through the odour filter (71) at a speed measuring between 0.5 m/sec and 3.0 m/sec, preferably between 0.7 m/sec and 2.7 m/sec, in particular between 1.0 m/sec and 2.5 m/sec.

As a rule, the distance (43) between the bottom side (35) of the hob (1) on the one hand and the bottom side (45) of the housing (44) for the heating or hob heating and control electronics on the other can measure between 45 mm and 80 mm. In general, the distance (46) between the bottom side (45) of the housing (44) for the heating or hob heating and control electronics on the one hand and the bottom side (47) of the fan housing (48) on the other can measure between 60 mm and 100 mm. The distance (49) between the bottom side (47) of the fan housing (48) on the one hand and the bottom side of the floor (42) of the cooking vapour aspiration chamber (39) on the other can measure between 45 mm and 80 mm, for example.

As evident in particular from FIG. 15, two radial fans (38) as viewed from above can be positioned in the fan housing (48) on either side of the tubular foul air line (50) provided downstream from the central hob recess (4). The rotating directions (73) of the two fan wheels (65) of these two radial fans (38) are then preferably opposite to each other: According to FIG. 15, the left fan wheel (65) can be rotatively driven counterclockwise as viewed from above, while the right fan wheel (65) can then be rotatively driven clockwise as viewed from above. In this case, the two pressure chambers (67) of the two radial fans (38) can be adjacent to the central foul air line (50).

The advantage to oppositely aligning the rotational directions (73) according to FIG. 15 is that the two cooking vapour exhaust flows (69) stream toward the odour filter (71) provided downstream from the space (68) for dividing and aligning the exhaust flows (69), either indirectly by way of air guiding surfaces (70), or in a uniformly direct manner.

In particular FIG. 14 shows that, as viewed from above, the central floor area (74) located inside the hollow cylindrical grease filter (6) can be at least somewhat recessed at least in relation to the lateral floors (42) of the two aspiration chambers (39) provided on either side of this central floor area (74), with the formation of a stop (75) for the lower edge area (53) of the hollow cylindrical grease filter (6). The central floor area (74) can further be inclined relative to a central or edge recess (76) so as to collect and trap overflowed liquid. In this case, the operator is provided with especially convenient access to the central floor area (74) for cleaning purposes.

In sum, let it be noted that the present invention provides a hob with a device for removing cooking vapours through suction in a direction lying vertically below the plane of the hob. For the first time ever, a cooking vapour removal device is combined with a hob in the device according to the invention to form a single component, thereby yielding especially low manufacturing and assembly costs.

Since the area of the geometric centre (3) of the hob (1) according to the invention exhibits a round or oval or square recess (4) as viewed from above for a device (5) used to remove cooking vapours through suction in a downward direction pointing vertically below the hob (1), the surfaces located on either side and in back of the hob can now for the first time ever be unrestrictedly used on the countertop that carries the hob for temporary storage or similar purposes.

Since the device (5) for the removal of cooking vapours is now centrally provided in the area of the geometric centre (3) of the hob (1), sufficiently strong suction flows that do not cancel each other out act on the entire surface of the hob (1). This reliably prevents cooking vapours from rising and expanding in both the central area of the hob and in its edge areas.

Other special advantages to the hob (1) according to the invention have to do with the fact that its manufacturing, assembly, maintenance and operating costs are especially low.

Also advantageous with respect to the hob (1) according to the invention is that the electrical energy going toward suction removal is used especially efficiently, giving the hob (1) according to the invention a particularly high level of efficiency.

Another advantage to the hob (1) according to the invention lies in the fact that the noise generation is very low even during cooking vapour suction removal operation.

With respect to the hob (1) according to the invention designed as an assembly unit with a device (36), let it be noted in summation that its design height is particularly low, so that extensive space is available for unimpeded use in the kitchen structure.

Another special advantage to the hob (1) according to the invention designed as an assembly unit with a device (36) involves its compactness, and the fact that it can be completely preassembled at the factory. As a result, the planning and assembly outlay is especially low.

Finally, the completely preassembled, compact assembly unit must now only be placed in a recess of the countertop, making assembly especially fast, simple and cost-effective.

Providing two or more opposing radial fans (38) downstream from the hollow cylindrical grease filter (6) according to FIGS. 17 and 18 markedly enlarges the working surface of the grease filter (6) and elevates the throughput volume, while at the same time improving the level of grease separation and generating an especially low pressure loss on the larger, effectively active grease filter surface (6). The advantage to this is that the fan motors (56) of the radial fans (38) can exhibit an especially small, energy-saving, energy-efficient and quiet design. In addition, a lower speed can be selected for the fan motors (56), as a result of which the radial fans (38) used according to the invention operate in an especially quiet, low-vibration and energy-efficient manner.

One special advantage to the hob (1) according to the invention designed as an assembly unit with a device (36) is that it offers effective protection against and insensitivity to overflowed liquid that has penetrated through the central recess (4) up to a volume of 5 liters. This is because suspending the fan motors (56) on the floor (45) of the housing (44) for the heating or hob heating and control electronics essentially makes the trough-like volume of the deepest cooking vapour aspiration chamber (39) available for accommodating overflowed liquid, precluding any danger to the fan motors (56).

The invention claimed is:

1. A mounting unit, comprising a cooktop having one or more cooking locations on a top surface thereof and one or more recesses;

a device configured to operate the cooktop and to remove cooking vapors that arise from the one or more cooking locations downwards, the device being disposed at a bottom side of the cooktop, the one or more recesses being connected with the device to remove the cooking vapors therethrough, wherein a distance between a bottom surface of the cooktop and a bottom surface of a floor of the device for removing cooking vapors is between 110 millimeters and 260 millimeters, the device comprising a first housing for heating and control electronics, a fan housing for at least one radial fan for removing cooking vapors, and one or more cooking vapor aspiration chambers for horizontally relaying the cooking vapors toward the outside of the device and for preparing the cooking vapor stream to be vertically aspirated toward the top of the device by the at least one radial fan provided in the fan housing, the first housing being disposed directly above the fan housing within the device, the fan housing being disposed above the one or more cooking vapor aspiration chambers within the device, wherein each of the at least one radial fans comprises a suspended fan motor mounted at a bottom side of the first housing for heating and control electronics, each of the one or more recesses being arranged in an area that extends around a geometric center of the cooktop, the one or more recesses not extending in edge areas of the cooktop.

2. The mounting unit according to claim 1, wherein the fan housing is directly connected to the first housing.

3. The mounting unit according to claim 1, wherein the suspended fan motor has a vertically-aligned rotational axis.

4. The mounting unit according to claim 2, wherein the fan housing extends in a direction away from the first housing for heating and control electronics, the device being integrally connected to the cooktop to define a single, one-piece component, wherein the fan motors are suspended exclusively from the first housing for heating and control electronics.

5. The mounting unit according to claim 1, further comprising a single or multiple part grease filter insert having one floor area and at least one wall area, and wherein the floor area and the at least one wall area of the grease filter insert is permeable.

6. The mounting unit according to claim 1, wherein each of the one or more recesses is arranged to be reversibly closed via one or more closure elements.

7. The mounting unit according to claim 1, wherein the cooking vapors are able to flow through a grease filter insert that is inserted in one of the one or more recesses at a speed ranging from 1.0 meters/second to 4.5 meters/second.

8. The mounting unit according to claim 1, wherein the mounting unit is completely pre-assembled.

9. The mounting unit according to claim 1, wherein the distance between the bottom surface of the cooktop and the bottom surface of the floor of the device is at most 200 mm.

10. The mounting unit according to claim 1, wherein the mounting unit can be placed in a recess of a countertop.

11. The mounting unit according to claim 2, wherein a distance between a bottom side of the housing for heating and control electronics and a bottom side of the fan housing is in the range of 60 mm to 100 mm.

12. The mounting unit according to claim 2, wherein a distance between a bottom side of the fan housing and a bottom side of the vapor aspiration chamber is in the range of 45 mm to 80 mm.

13. The mounting unit according to claim 1, wherein the suspended fan motor is arranged in a middle area above each cooking vapor aspiration chamber.

14. The mounting unit according to claim 1, wherein a diameter of an area for the one or more recesses measures between 10% and 90% of an overall width of the cooktop.

15. The mounting unit according to claim 1, wherein the cooktop has a surface extending from one side of the cooktop to another side of the cooktop, the surface defining at least a portion of the one or more cooking locations and at least a portion of the one or more recesses.

16. A mounting unit, comprising:

a cooktop having one or more cooking locations on a top surface thereof and one or more recesses;

a device configured to operate the cooktop and to remove cooking vapors that arise from the one or more cooking locations downwards, the device being disposed at a bottom side of the cooktop, the one or more recesses being connected with the device to remove the cooking vapors therethrough, wherein a distance between a bottom surface of the cooktop and a bottom surface of a floor of the device for removing cooking vapors is between 110 millimeters and 260 millimeters, the device comprising a first housing for heating and control electronics, a fan housing for at least one radial fan for removing cooking vapors, and one or more cooking vapor aspiration chambers for horizontally relaying the cooking vapors toward the outside of the device and for preparing the cooking vapor stream to be vertically aspirated in an upward direction by the at least one radial fan, the first housing being disposed directly above the fan housing within the device, the fan housing being disposed directly above the one or more cooking vapor aspiration chambers within the device, wherein the at least one radial fan comprises a suspended motor mounted at a bottom side of the housing for heating and control electronics; and a collecting basin that is provided underneath the one or more recesses of the cooktop for collecting liquids.

17. The mounting unit according to claim 16, further comprising a single or multiple part grease filter insert having one floor area and at least one wall area, wherein the floor area and the at least one wall area of the grease filter insert is permeable.

18. The mounting unit according to claim 16, wherein each of the one or more recesses is arranged in an area that extends around a geometric center of the cooktop, the one or more recesses not extending in edge areas of the cooktop.

19. A mounting unit, comprising:

a cooktop having one or more cooking locations on a top surface thereof and one or more recesses;

a device configured to operate the cooktop and to remove cooking vapors that arise from the one or more cooking locations downwards, the device being disposed at a bottom side of the cooktop, the one or more recesses being connected with the device to remove the cooking vapors therethrough, wherein a distance between a bottom surface of the cooktop and a bottom surface of a floor of the device for removing cooking vapors is between 110 millimeters and 260 millimeters, the device comprising a first housing for heating and control electronics, a fan housing for at least one radial fan for removing cooking vapors, and one or more cooking vapor aspiration chambers for horizontally relaying the cooking vapors toward the outside of the device and for preparing the cooking vapor stream to be vertically aspirated toward the top of the device by the at least one radial fan, the first housing being disposed directly above the fan housing within the device, the fan housing being disposed directly above the one or more cooking vapor aspiration chambers within the device, the at least one radial fan comprising a suspended fan motor mounted at a bottom side of the housing for heating and control electronics; and a grease filter insert that is configured to be reversibly inserted in one of the one or more recesses, and wherein a floor area of the grease filter insert is designed as a collecting tray for collecting liquids in the floor area of the grease filter insert.

20. The mounting unit according to claim 19, further comprising a collecting basin that is provided underneath the one or more recesses of the cooktop for collecting liquids.

21. The mounting unit according to claim 19, wherein each of the one or more recesses is arranged in an area that extends around a geometric center of the cooktop, the one or more recesses not extending in edge areas of the cooktop.

* * * * *